US012092092B2

(12) United States Patent
Hahn et al.

(10) Patent No.: US 12,092,092 B2
(45) Date of Patent: Sep. 17, 2024

(54) LINEAR COMPRESSOR AND PLANAR SPRING ASSEMBLY

(71) Applicant: Haier US Appliance Solutions, Inc., Wilmington, DE (US)

(72) Inventors: Gregory William Hahn, Mt.Washington, KY (US); Adam Kemerer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 380 days.

(21) Appl. No.: 17/568,036

(22) Filed: Jan. 4, 2022

(65) Prior Publication Data

US 2023/0213025 A1 Jul. 6, 2023

(51) Int. Cl.
*F04B 35/04* (2006.01)
*F25B 31/02* (2006.01)

(52) U.S. Cl.
CPC ..... *F04B 35/045* (2013.01); *F25B 31/023* (2013.01); *F25B 2400/073* (2013.01)

(58) Field of Classification Search
CPC .. F04B 35/045; F04B 39/0005; F04B 39/023; F25B 31/023; F25B 2400/073; F25B 31/004
See application file for complete search history.

(56) References Cited

U.S. PATENT DOCUMENTS

| | | | | |
|---|---|---|---|---|
| 3,945,373 | A * | 3/1976 | Tweed | A61B 5/4356 600/595 |
| 6,540,485 | B2 * | 4/2003 | Nara | F04B 35/04 417/415 |
| 6,742,998 | B2 | 6/2004 | Kawahara | |
| 7,078,832 | B2 | 7/2006 | Inagaki | |
| 7,614,856 | B2 | 11/2009 | Inagaki | |
| D658,681 | S | 5/2012 | Takemori | |
| 9,103,332 | B2 * | 8/2015 | Hiratsuka | F04B 17/042 |
| 9,183,975 | B2 * | 11/2015 | Aigner | H01F 7/16 |
| 9,234,554 | B2 * | 1/2016 | Dadd | F16F 1/10 |
| 9,562,525 | B2 * | 2/2017 | Hahn | F04B 35/045 |
| 9,810,278 | B2 | 11/2017 | Huang | |
| 2007/0041856 | A1 | 2/2007 | Hansen | |
| 2009/0263262 | A1 | 10/2009 | McGilianl | |
| 2014/0241911 | A1 * | 8/2014 | Roman | F04B 39/1073 417/328 |

(Continued)

FOREIGN PATENT DOCUMENTS

WO WO2002066854 A1 8/2002

*Primary Examiner* — Dominick L Plakkoottam
(74) *Attorney, Agent, or Firm* — Dority & Manning, P.A.

(57) ABSTRACT

A linear compressor or sealed system may include a casing, a piston, an driving coil, an inner back iron assembly, and a planar spring assembly. The casing may include a cylinder assembly defining a chamber along an axial direction. The piston may be slidably received within the chamber of the cylinder assembly. The inner back iron assembly may be positioned in the driving coil. The planar spring assembly may be mounted to the inner back iron assembly. The planar spring assembly may include a first planar spring, a second planar spring axially spaced apart from the first planar spring, and a polymer shim layer disposed between at least a portion of the first planar spring and the second planar spring.

20 Claims, 7 Drawing Sheets

(56) References Cited

U.S. PATENT DOCUMENTS

| | | | | |
|---|---|---|---|---|
| 2015/0226197 | A1* | 8/2015 | Hahn | F04B 39/122<br>417/363 |
| 2016/0017877 | A1 | 1/2016 | Ki | |
| 2016/0290427 | A1* | 10/2016 | Huang | F16F 3/00 |
| 2018/0171994 | A1 | 6/2018 | Ki | |
| 2018/0238313 | A1* | 8/2018 | Hahn | F04B 39/0061 |
| 2020/0355176 | A1* | 11/2020 | Hahn | F04B 39/04 |

* cited by examiner

LINEAR COMPRESSOR AND PLANAR SPRING ASSEMBLY

FIELD OF THE INVENTION

The present subject matter relates generally to linear compressors, such as for a refrigerator appliance.

BACKGROUND OF THE INVENTION

Certain refrigerator appliances include sealed systems for cooling chilled chambers of the refrigerator appliance. The sealed systems generally include a compressor that generates compressed refrigerant during operation of the sealed system. The compressed refrigerant flows to an evaporator where heat exchange between the chilled chambers and the refrigerant cools the chilled chambers and food items located therein.

Recently, certain refrigerator appliances have included linear compressors for compressing refrigerant. Linear compressors generally include a piston and a driving coil. The driving coil receives a current that generates a force for sliding the piston forward and backward within a chamber. During motion of the piston within the chamber, the piston compresses refrigerant. One or more spring assemblies (e.g., planar spring assemblies) may be used to support more or more portions of the compressor, such as a iron assembly, and help transfer or dampen reciprocating motion of the piston.

Generally, spring assemblies for linear compressors include multiple discrete planar springs that can be stacked along the axial direction to act in concert to absorb or transfer energy from movement along the axial direction (e.g., at the piston). In particular, the discrete planar springs can be joined together such that the planar springs are axially compressed or otherwise held stationary relative to the planar spring assemblies. One of the issues that can arise with such arrangements, though, is the generation of fretting fatigue. For instance, stress or friction on the connection points between two planar springs may generate surface cracks on the planar springs that can, in turn, lead to premature breaking or failure. In some cases, the planar springs may lose as much as 80% of their predicted strength due to fretting fatigue generated during use.

As a result, there is a need for improved linear compressors. In particular, it would be advantageous to provide a linear compressor or assembly for reducing or mitigating the effects of fretting fatigue, for instance, at a planar spring assembly.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a linear compressor for an appliance is provided. The linear compressor may include a casing, a piston, an driving coil, an inner back iron assembly, and a planar spring assembly. The casing may include a cylinder assembly defining a chamber along an axial direction. The piston may be slidably received within the chamber of the cylinder assembly. The inner back iron assembly may be positioned in the driving coil. The planar spring assembly may be mounted to the inner back iron assembly. The planar spring assembly may include a first planar spring, a second planar spring axially spaced apart from the first planar spring, and a polymer shim layer disposed between at least a portion of the first planar spring and the second planar spring.

In another exemplary aspect of the present disclosure, a sealed system for an appliance is provided. The sealed system may include a linear compressor, a shell, a condenser, and an evaporator. The linear compressor may define an axial direction and include a casing, a piston, an driving coil, an inner back iron assembly, and a planar spring assembly. The casing may include a cylinder assembly defining a chamber along an axial direction. The piston may be slidably received within the chamber of the cylinder assembly. The inner back iron assembly may be positioned in the driving coil. The planar spring assembly may be mounted to the inner back iron assembly. The planar spring assembly may include a first planar spring, a second planar spring axially spaced apart from the first planar spring, and a polymer shim layer disposed between at least a portion of the first planar spring and the second planar spring. The shell may define an internal volume enclosing the linear compressor and lubrication oil therein. The condenser may be in downstream fluid communication with the linear compressor to receive a compressed refrigerant therefrom. The evaporator may be in upstream fluid communication with the linear compressor to direct an expanded refrigerant thereto.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
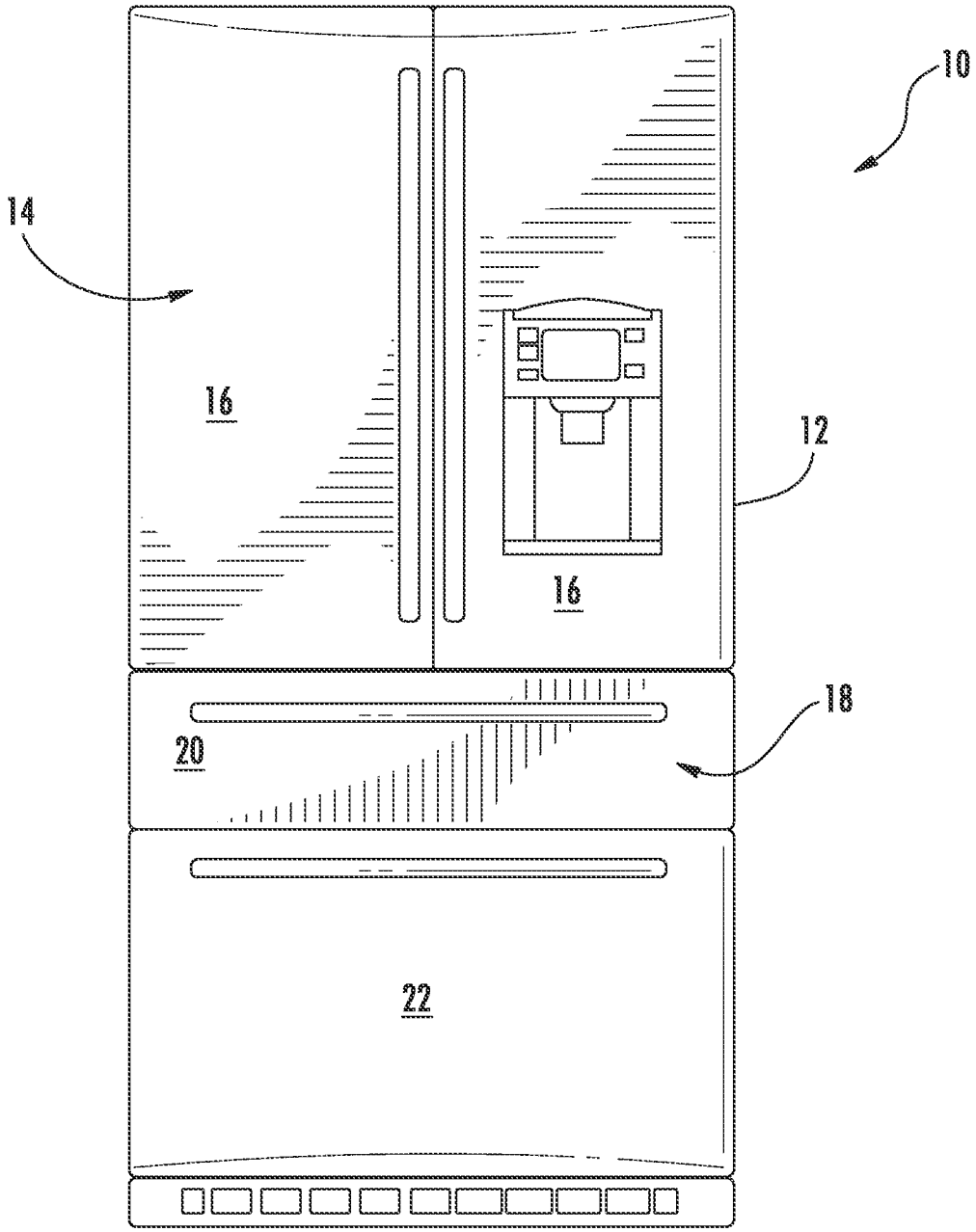
FIG. 1 is a front elevation view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components.

Figure 2:
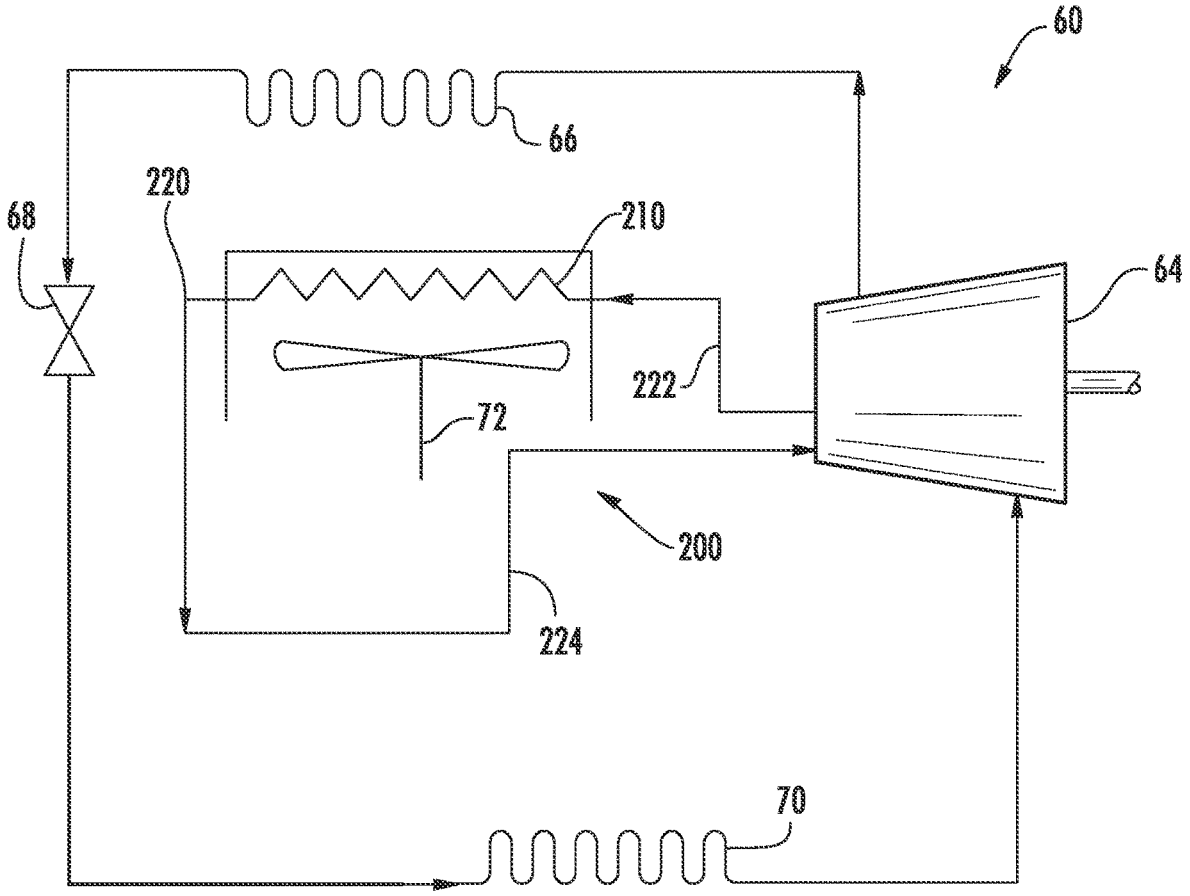
FIG. 2 is a schematic view of certain components of the exemplary refrigerator appliance of FIG. 1 with optional oil cooling circuits in which a linear compressor may operate.

Turning now to the figures, FIG. 1 depicts a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present disclosure is not limited to use in refrigerator appliances. Thus, the present subject matter may be used for any other suitable purpose, such as vapor compression within air conditioning units or air compression within air compressors.

In the illustrated exemplary embodiment shown in FIG. 1, the refrigerator appliance 10 is depicted as an upright refrigerator having a cabinet or casing 12 that defines a number of internal chilled storage compartments. In particular, refrigerator appliance 10 includes upper fresh-food compartments 14 having doors 16 and lower freezer compartment 18 having an upper drawer 20 and a lower drawer 22. The drawers 20 and 22 are "pull-out" drawers in that they can be manually moved into and out of the freezer compartment 18 on suitable slide mechanisms.

FIG. 2 provides schematic views of certain components of refrigerator appliance 10, including a sealed refrigeration system 60 of refrigerator appliance 10. In particular, FIG. 2 provides an optional oil cooling circuit with sealed refrigeration system 60 having a linear compressor 64

A machinery compartment of refrigerator appliance 10 may contain components for executing a known vapor compression cycle for cooling air. The components include a compressor 64, a condenser 66, an expansion device 68, and an evaporator 70 connected in series and charged with a refrigerant. As will be understood by those skilled in the art, refrigeration system 60 may include additional components (e.g., at least one additional evaporator, compressor, expansion device, or condenser). As an example, refrigeration system 60 may include two evaporators.

Within refrigeration system 60, refrigerant generally flows into compressor 64, which operates to increase the pressure of the refrigerant. This compression of the refrigerant raises its temperature, which is lowered by passing the refrigerant through condenser 66. Within condenser 66, heat exchange with ambient air takes place so as to cool the refrigerant. A condenser fan 72 is used to pull air across condenser 66 so as to provide forced convection for a more rapid and efficient heat exchange between the refrigerant within condenser 66 and the ambient air. Thus, as will be understood by those skilled in the art, increasing air flow across condenser 66 can, for example, increase the efficiency of condenser 66 by improving cooling of the refrigerant contained therein.

An expansion device (e.g., a valve, capillary tube, or other restriction device) 68 receives refrigerant from condenser 66. From expansion device 68, the refrigerant enters evaporator 70. Upon exiting expansion device 68 and entering evaporator 70, the refrigerant drops in pressure. Due to the pressure drop or phase change of the refrigerant, evaporator 70 is cool relative to compartments 14 and 18 of refrigerator appliance 10. As such, cooled air is produced and refrigerates compartments 14 and 18 of refrigerator appliance 10. Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through compartments 14, 18 (FIG. 1). The refrigeration system 60 depicted in FIG. 2 is provided by way of example only. Thus, it is within the scope of the present disclosure for other configurations of the refrigeration system to be used as well.

In some embodiments, an oil cooling circuit 200 according exemplary embodiments of the present disclosure is shown with refrigeration system 60. Compressor 64 of refrigeration system 60 may include or be provided within a shell 302 (FIG. 3) that also holds a lubrication oil therein. The lubrication oil may assist with reducing friction between sliding or moving components of compressor 64 during operation of compressor 64. For example, the lubrication oil may reduce friction between a piston and a cylinder of compressor 64 when the piston slides within the cylinder to compress refrigerant, as discussed in greater detail below.

During operation of compressor 64, the lubrication oil may increase in temperature. Thus, in optional embodiments, oil cooling circuit 200 is provided to assist with rejecting heat from the lubrication oil.

In the illustrated embodiments of FIG. 2, oil cooling circuit 200 includes a heat exchanger 210 is spaced apart from at least a portion of compressor 64. A lubrication oil conduit 220 extends between compressor 64 and heat exchanger 210. Lubrication oil from compressor 64 may flow to heat exchanger 210 via lubrication oil conduit 220. As shown in FIG. 2, lubrication oil conduit 220 may include a supply conduit 222 and a return conduit 224. Supply conduit 222 extends between compressor 64 and heat exchanger 210 and is configured for directing lubrication oil from compressor 64 to heat exchanger 210. Conversely, return conduit 224 extends between heat exchanger 210 and compressor 64 and is configured for directing lubrication oil from heat exchanger 210 to compressor 64.

Within heat exchanger 210, the lubrication oil may reject heat to ambient air about heat exchanger 210. From heat exchanger 210, the lubrication oil flows back to compressor 64 via lubrication oil conduit 220. In such a manner, lubrication oil conduit 220 may circulate lubrication oil between compressor 64 and heat exchanger 210, and heat exchanger 210 may reduce the temperature of lubrication oil from compressor 64 before returning the lubrication oil to compressor 64. Thus, oil cooling circuit 200 may remove lubrication oil from compressor 64 via lubrication oil conduit 220 and return the lubrication oil to compressor 64 via lubrication oil conduit 220 after cooling the lubrication oil in heat exchanger 210.

In some embodiments, heat exchanger 210 is positioned at or adjacent fan 72. For example, heat exchanger 210 may be positioned and oriented such that fan 72 pulls or urges air across heat exchanger 210 so as to provide forced convection for a more rapid and efficient heat exchange between lubrication oil within heat exchanger 210 and ambient air about refrigeration system 60. In certain exemplary embodiments, heat exchanger 210 may be disposed between fan 72 and condenser 66. Thus, heat exchanger 210 may be disposed downstream of fan 72 and upstream of condenser 66 relative to a flow of air from fan 72. In such a manner, air from fan 72 may heat exchange with lubrication oil in heat exchanger 210 prior to heat exchange with refrigerant in condenser 66.

In additional or alternative embodiments, heat exchanger 210 is positioned at or on condenser 66. For example, heat exchanger 210 may be mounted to condenser 66 such that heat exchanger 210 and condenser 66 are in conductive thermal communication with each other. Thus, condenser 66 and heat exchanger 210 may conductively exchange heat. In such a manner, heat exchanger 210 and condenser 66 may provide for heat exchange between lubrication oil within heat exchanger 210 and refrigerant within condenser 66.

In certain exemplary embodiments, heat exchanger 210 may be a tube-to-tube heat exchanger 210 integrated within or onto condenser 66 (e.g., a portion of condenser 66). For example, heat exchanger 210 may be welded or soldered onto condenser 66. In optional embodiments, heat exchanger 210 is disposed on a portion of condenser 66 between an inlet and an outlet of condenser 66. For example, refrigerant may enter condenser 66 at the inlet of condenser 66 at a first temperature (e.g., one hundred and fifty degrees Fahrenheit (150° F.)), and heat exchanger 210 may be positioned on condenser 66 downstream of the inlet of condenser 66 such that refrigerant immediately upstream of the portion of condenser 66 where heat exchanger 210 is mounted may have a second temperature (e.g., ninety degrees Fahrenheit (90° F.)).

Heat exchanger 210 may also be positioned on condenser 66 upstream of the outlet of condenser 66 such that refrigerant immediately downstream of the portion of condenser 66 where heat exchanger 210 is mounted may have a third temperature (e.g., one hundred and five degrees Fahrenheit (105° F.)), and refrigerant may exit condenser 66 at the outlet of condenser 66 at a fourth temperature (e.g., ninety degrees Fahrenheit (90° F.)). Thus, refrigerant within condenser 66 may increase in temperature at the portion of condenser 66 where heat exchanger 210 is mounted during operation of compressor 64 in order to cool lubrication oil within heat exchanger 210. However, the portion of condenser 66 downstream of heat exchanger 210 may assist with rejecting heat to ambient air about condenser 66.

It is noted that although the exemplary embodiments of FIG. 2 illustrate an oil cooling circuit 200, alternative embodiments having different cooling configurations for oil within the compressor 64 may be provided. Thus, except as otherwise indicate, FIG. 2 is provided solely for illustrative purposes and does not limit the present disclosure.

Figure 3:
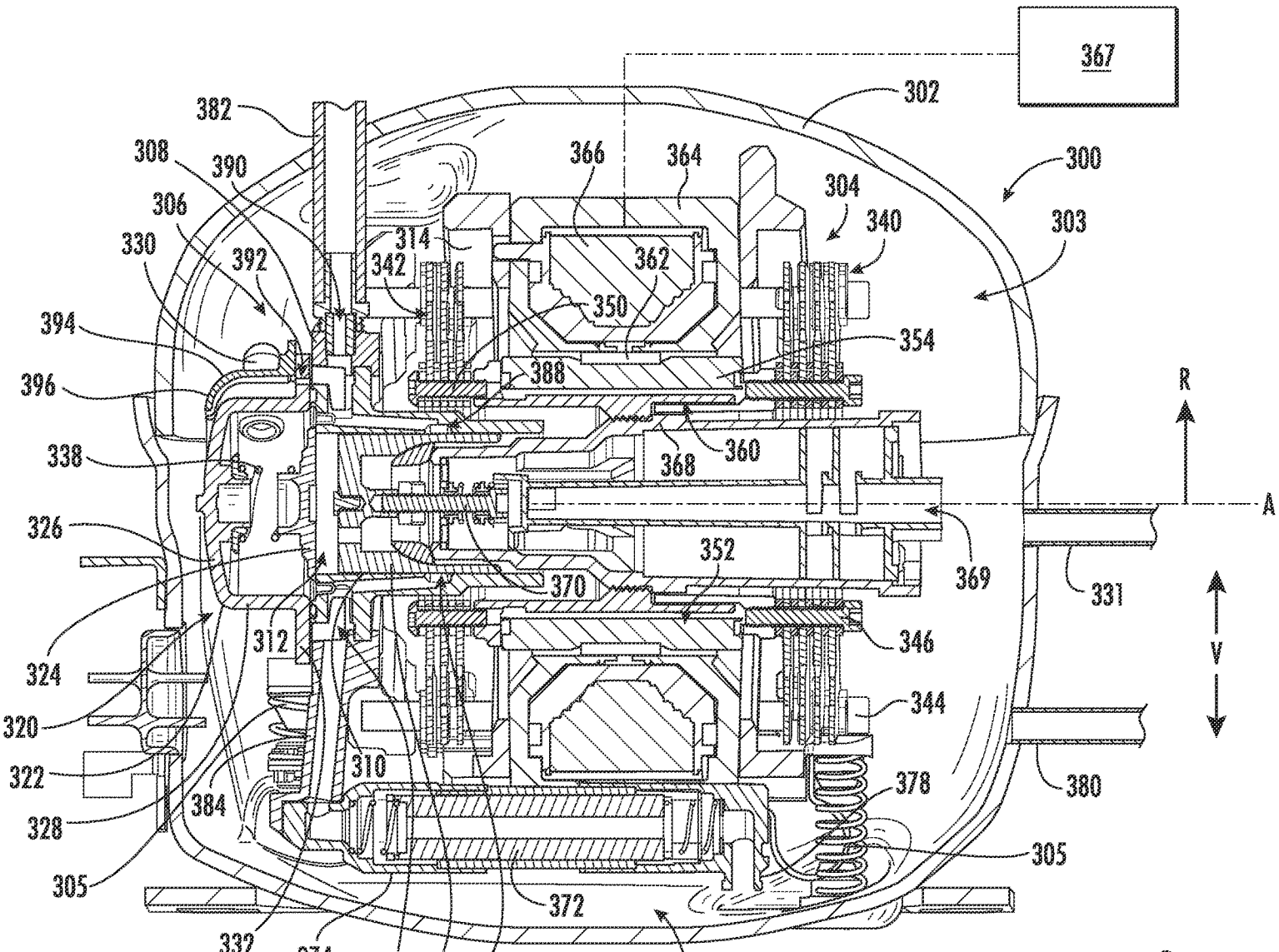
FIG. 3 provides a section view of an exemplary linear compressor according to exemplary embodiments of the present disclosure.
Figure 4:
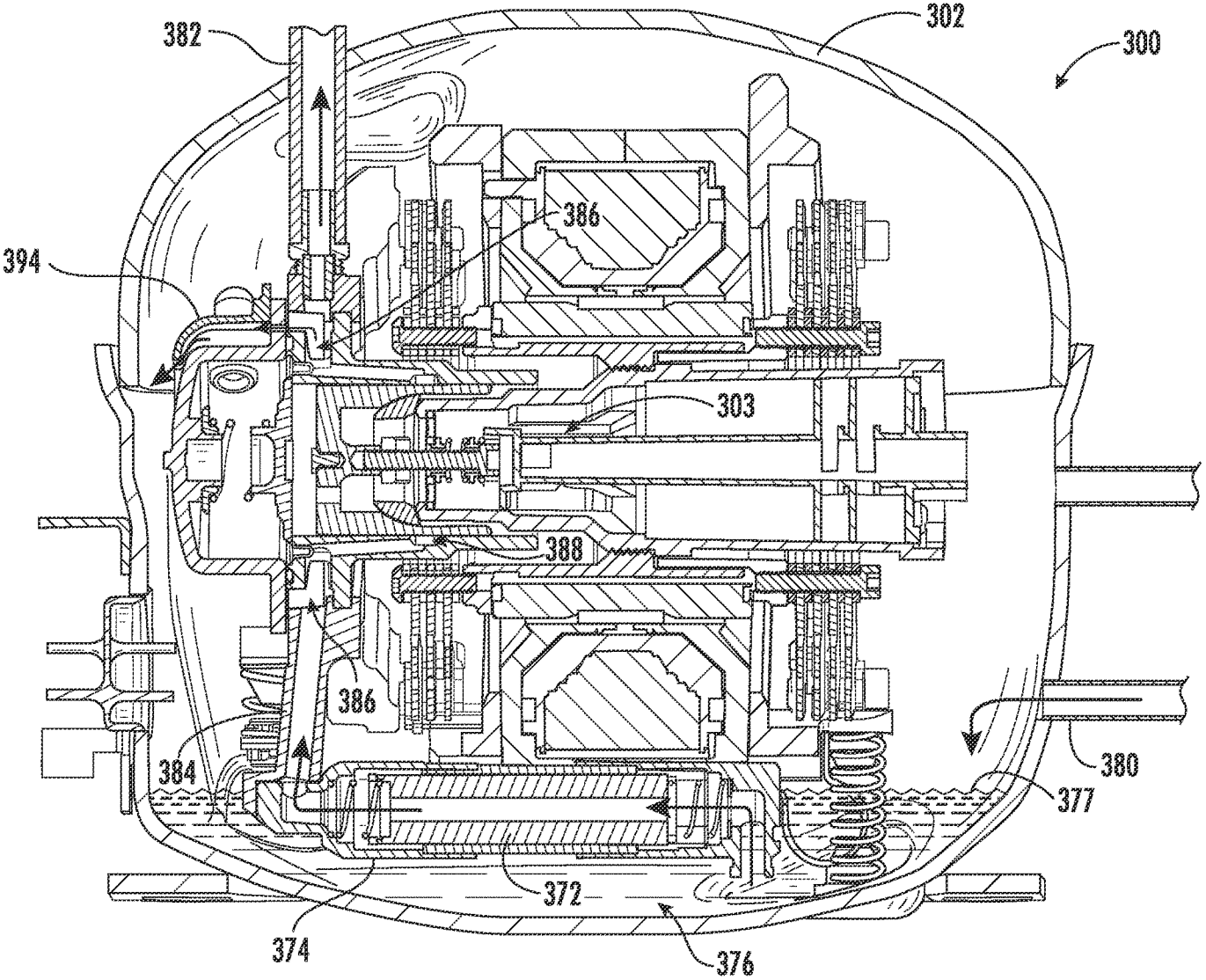
FIG. 4 provides a section view of the exemplary linear compressor of FIG. 3, illustrating a flow path according to exemplary embodiments of the present disclosure.

Turning now to FIGS. 3 and 4, various sectional views are provided of a linear compressor 300 according to an exemplary embodiments of the present disclosure. As discussed in greater detail below, linear compressor 300 is operable to increase a pressure of fluid within a chamber 312 of linear compressor 300. Linear compressor 300 may be used to compress any suitable fluid, such as refrigerant. In particular, linear compressor 300 may be used in a refrigerator appliance, such as refrigerator appliance 10 (FIG. 1) in which linear compressor 300 may be used as compressor 64 (FIG. 2). As may be seen in FIG. 3, linear compressor 300 defines an axial direction A and a radial direction R. Linear compressor 300 may be enclosed within a hermetic or air-tight shell 302. In other words, linear compressor 300 may be enclosed within an internal volume 303 defined by shell 302. For instance, linear compressor may be supported within internal volume 303 by one or more mounting springs 305, which may generally dampen oscillations or movement of linear compressor 300 relative to shell 302. When assembled, hermetic shell 302 hinders or prevents refrigerant or lubrication oil from leaking or escaping refrigeration system 60 (FIG. 2).

Linear compressor 300 includes a casing 308 that extends between a first end portion 304 and a second end portion 306 (e.g., along the axial direction A). Casing 308 includes various relatively static or non-moving structural components of linear compressor 300. In particular, casing 308 includes a cylinder assembly 310 that defines a chamber 312. Cylinder assembly 310 may be positioned at or adjacent second end portion 306 of casing 308. Chamber 312 may extend longitudinally along the axial direction A.

In some embodiments, a motor mount mid-section 314 (e.g., at the second end portion 306) of casing 308 supports a stator of the motor. As shown, the stator may include an outer back iron 364 and a driving coil 366 sandwiched between the first end portion 304 and the second end portion 306. Linear compressor 300 may also include one or more valves (e.g., a discharge valve assembly 320 at an end of chamber 312) that permit refrigerant to enter and exit chamber 312 during operation of linear compressor 300.

In some embodiments, a discharge valve assembly 320 is mounted to the casing 308 (e.g., at the second end portion 306). Discharge valve assembly 320 may include a muffler housing 322, a valve head 324, and a valve spring 338.

Muffler housing 322 may include an end wall 326 and a cylindrical side wall 328. Cylindrical side wall 328 is mounted to end wall 326, and cylindrical side wall 328 extends from end wall 326 (e.g., along the axial direction A) to cylinder assembly 310 of casing 308. A refrigerant outlet conduit 330 may extend from or through muffler housing 322 and through shell 302 (e.g., to or in fluid communication with condenser 66-FIG. 2) to selectively permit refrigerant from discharge valve assembly 320 during operation of linear compressor 300.

Muffler housing 322 may be mounted or fixed to casing 308, and other components of discharge valve assembly 320 may be disposed within muffler housing 322. For example, a plate 332 of muffler housing 322 at a distal end of cylindrical side wall 328 may be positioned at or on cylinder assembly 310, and a seal (e.g., O-ring or gasket) may extend between cylinder assembly 310 and plate 332 of muffler housing 322 (e.g., along the axial direction A) in order to limit fluid leakage at an axial gap between casing 308 and muffler housing 322. Fasteners may extend through plate 332 into casing 308 to mount muffler housing 322 to casing 308.

In some embodiments, valve head 324 is positioned at or adjacent chamber 312 of cylinder assembly 310. Valve head 324 may selectively a passage that extends through the cylinder assembly 310 (e.g., along the axial direction A). Such a passage may be contiguous with chamber 312. When assembled, valve spring 338 may be coupled to muffler housing 322 and valve head 324. Valve spring 338 may be configured to urge valve head 324 towards or against cylinder assembly 310 (e.g., along the axial direction A).

A piston assembly 316 with a piston head 318 may be slidably received within chamber 312 of cylinder assembly 310. In particular, piston assembly 316 may be slidable along the axial direction A within chamber 312. During sliding of piston head 318 within chamber 312, piston head 318 compresses refrigerant within chamber 312. As an example, from a top dead center position, piston head 318 can slide within chamber 312 towards a bottom dead center position along the axial direction A (i.e., an expansion stroke of piston head 318). When piston head 318 reaches the bottom dead center position, piston head 318 changes directions and slides in chamber 312 back towards the top dead center position (i.e., a compression stroke of piston head 318). As, or immediately prior to, piston head 318 reaching the top dead center position, expansion valve assembly 320 may open. For instance, valve head 324 may be urged away from cylinder assembly 310, permitting refrigerant from chamber 312 and through discharge valve assembly 320 to refrigerant outlet conduit 330.

It should be understood that linear compressor 300 may include an additional piston head or additional chamber at an opposite end of linear compressor 300 (e.g., proximal to first end portion 304). Thus, linear compressor 300 may have multiple piston heads in alternative exemplary embodiments.

In certain embodiments, linear compressor 300 includes an inner back iron assembly 352. Inner back iron assembly 352 is positioned in the stator of the motor. In particular, outer back iron 364 or driving coil 366 may extend about inner back iron assembly 352 (e.g., along a circumferential direction). Inner back iron assembly 352 also has the outer surface. At least one driving magnet 362 is mounted to inner back iron assembly 352 (e.g., at the outer surface of inner back iron assembly 352). Driving magnet 362 may face or be exposed to driving coil 366. In particular, driving magnet 362 may be spaced apart from driving coil 366 (e.g., along the radial direction R by an air gap). Thus, the air gap may be defined between opposing surfaces of driving magnet 362 and driving coil 366. Driving magnet 362 may also be mounted or fixed to inner back iron assembly 352 such that the outer surface of driving magnet 362 is substantially flush with the outer surface of inner back iron assembly 352. Thus, driving magnet 362 may be inset within inner back iron assembly 352. In such a manner, the magnetic field from driving coil 366 may have to pass through only a single air gap between outer back iron 364 and inner back iron assembly 352 during operation of linear compressor 300.

As may be seen in FIG. 3, driving coil 366 extends about inner back iron assembly 352 (e.g., along the circumferential direction). Generally, driving coil 366 is operable to move the inner back iron assembly 352 along the axial direction A during operation of driving coil 366. As an example, a current may be induced in driving coil 366 by a current source (e.g., included with or in connection with a controller 367) to generate a magnetic field that engages driving magnet 362 and urges piston assembly 316 to move along the axial direction A in order to compress refrigerant within chamber 312, as described above. In particular, the magnetic field of driving coil 366 may engage driving magnet 362 in order to move inner back iron assembly 352 and piston head 318 the axial direction A during operation of driving coil 366. Thus, driving coil 366 may slide piston assembly 316 between the top dead center position and the bottom dead center position during operation of driving coil 366.

In optional embodiments, linear compressor 300 includes various components for permitting or regulating operation of linear compressor 300. In particular, linear compressor 300 includes a controller 367 that is configured for regulating operation of linear compressor 300. The controller 367 is in, for example, operative, communication with the motor (e.g., driving coil 366 of the motor). Thus, the controller 367 may selectively activate driving coil 366, for example, by supplying current to driving coil 366, in order to compress refrigerant with piston assembly 316 as described above. In some embodiments, controller 367 directs or regulates current according to a predetermined control loop. For instance, as would be understood, such a control loop may regulate the supply voltage [e.g., peak voltage or root mean square (RMS) voltage] of a supplied current to a desired reference voltage. To that end, controller 367 may include a suitable component for measuring or estimating a supply current, such as an ammeter. Additionally or alternatively, controller 367 may be configured to detect or mitigate an internal collision (e.g., according to one or more programmed methods, such as method 700).

The controller 367 includes memory and one or more processing devices such as microprocessors, CPUs or the like, such as general or special purpose microprocessors operable to execute programming instructions or microcontrol code associated with operation of linear compressor 300. The memory can represent random access memory such as DRAM, or read only memory such as ROM or FLASH. The processor executes programming instructions stored in the memory. The memory can be a separate component from the processor or can be included onboard within the processor. Alternatively, the controller 367 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Linear compressor 300 also includes one or more spring assemblies (e.g., 340, 342) mounted to casing 308. In certain embodiments, a pair of spring assemblies (i.e., a first spring assembly 340 and a second spring assembly 342) bounds driving coil 366 along the axial direction A. In other words, a first spring assembly 340 is positioned proximal to the first end portion 304 and a second spring assembly 342 is positioned proximal to the second end portion 306.

In some embodiments, each spring assembly 340 and 342 includes one or more planar springs that are mounted or secured to one another. As will be described in greater detail below, planar springs may be mounted or secured to one another such that each planar spring of a corresponding assembly 340 or 342 are spaced apart from one another (e.g., along the axial direction A).

Generally, the pair of spring assemblies 340, 342 assists with coupling inner back iron assembly 352 to casing 308. In some such embodiments, a first outer set of fasteners 344 (e.g., bolts, nuts, clamps, tabs, welds, solders, etc.) secure first and second spring assemblies 340, 342 to casing 308 (e.g., a bracket of the stator) while a first inner set of fasteners 346 that are radially inward (e.g., closer to the axial direction A along a perpendicular radial direction R) from the first outer set of fasteners 344 secure first spring assembly 340 to inner back iron assembly 352 at first end portion 304. In additional or alternative embodiments, a second inner set of fasteners 350 that are radially inward (e.g., closer to the axial direction A along the radial direction R) from the first outer set of fasteners 344 secure second spring assembly 342 to inner back iron assembly 352 at second end portion 306.

During operation of driving coil 366, the spring assemblies 340, 342 support inner back iron assembly 352. In particular, inner back iron assembly 352 is suspended by the spring assemblies 340, 342 within the stator or the motor of linear compressor 300 such that motion of inner back iron assembly 352 along the radial direction R is hindered or limited while motion along the axial direction A is relatively unimpeded. Thus, the spring assemblies 340, 342 may be substantially stiffer along the radial direction R than along the axial direction A. In such a manner, the spring assemblies 340, 342 can assist with maintaining a uniformity of the air gap between driving magnet 362 and driving coil 366 (e.g., along the radial direction R) during operation of the motor and movement of inner back iron assembly 352 on the axial direction A. The spring assemblies 340, 342 can also assist with hindering side pull forces of the motor from transmitting to piston assembly 316 and being reacted in cylinder assembly 310 as a friction loss.

In optional embodiments, inner back iron assembly 352 includes an outer cylinder 354 and a sleeve 360. Sleeve 360 is positioned on or at the inner surface of outer cylinder 354. A first interference fit between outer cylinder 354 and sleeve 360 may couple or secure outer cylinder 354 and sleeve 360 together. In alternative exemplary embodiments, sleeve 360 may be welded, glued, fastened, or connected via any other suitable mechanism or method to outer cylinder 354.

When assembled, sleeve 360 may extend about the axial direction A (e.g., along the circumferential direction). In exemplary embodiments, a first interference fit between outer cylinder 354 and sleeve 360 may couple or secure outer cylinder 354 and sleeve 360 together. In alternative exemplary embodiments, sleeve 360 is welded, glued, fastened, or connected via any other suitable mechanism or method to outer cylinder 354. As shown, sleeve 360 extends within outer cylinder 354 (e.g., along the axial direction A) between first and second end portions 304 and 306 of inner back iron assembly 352 130. First and second spring assemblies 340, 342 and are mounted to sleeve 360 (e.g., with inner set of fasteners 346 and 350).

Outer cylinder 354 may be constructed of or with any suitable material. For example, outer cylinder 354 may be constructed of or with a plurality of (e.g., ferromagnetic) laminations. The laminations are distributed along the circumferential direction in order to form outer cylinder 354 and are mounted to one another or secured together (e.g., with rings pressed onto ends of the laminations). Outer cylinder 354 defines a recess that extends inwardly from the outer surface of outer cylinder 354 (e.g., along the radial direction R). Driving magnet 362 may be positioned in the recess on outer cylinder 354 (e.g., such that driving magnet 362 is inset within outer cylinder 354).

In some embodiments, a piston flex mount 368 is mounted to and extends through inner back iron assembly 352. In particular, piston flex mount 368 is mounted to inner back iron assembly 352 via sleeve 360 and spring assemblies 340, 342. Thus, piston flex mount 368 may be coupled (e.g., threaded) to sleeve 360 in order to mount or fix piston flex mount 368 to inner back iron assembly 352. A coupling 370 extends between piston flex mount 368 and piston assembly 316 (e.g., along the axial direction A). Thus, coupling 370 connects inner back iron assembly 352 and piston assembly 316 such that motion of inner back iron assembly 352 (e.g., along the axial direction A) is transferred to piston assembly 316. Coupling 370 may extend through driving coil 366 (e.g., along the axial direction A).

Piston flex mount 368 may define at least one passage 369. Passage 369 of piston flex mount 368 extends (e.g., along the axial direction A) through piston flex mount 368. Thus, a flow of fluid, such as air or refrigerant, may pass through piston flex mount 368 via passage 369 of piston flex mount 368 during operation of linear compressor 300. As shown, one or more refrigerant inlet conduits 331 may extend through shell 302 to return refrigerant from evaporator 70 (or another portion of sealed system 60) (FIG. 2) to compressor 300.

Piston head 318 also defines at least one opening (e.g., selectively covered by a head valve). The opening of piston head 318 extends (e.g., along the axial direction A) through piston head 318. Thus, the flow of refrigerant may pass through piston head 318 via the opening of piston head 318 into chamber 312 during operation of linear compressor 300. In such a manner, the flow of fluid (that is compressed by piston head 318 within chamber 312) may flow through piston flex mount 368 and inner back iron assembly 352 to piston assembly 316 during operation of linear compressor 300.

As shown, linear compressor 300 may include features for directing oil through linear compressor 300 and oil cooling circuit 200 (FIG. 2). One or more oil inlet conduits 380 or oil outlet conduits 382 may extend through shell 302 to direct oil to/from oil cooling circuit 200. Alternatively, though, it is understood that other configurations for directing oil within shell 302 may be provided. For instance, oil may be recirculated solely within shell 302 (i.e., without requiring circulation of oil to/from cooling circuit 200). Additionally or alternatively, one or more conduits within shell 302 may connect to an internal hot wall heat exchanger for oil to cool as it descends back to the sump 376.

Optionally, oil inlet conduit 380 may be coupled to return conduit 224 of oil cooling circuit 200 (FIG. 2). Thus, from heat exchanger 210, lubrication oil may flow to linear compressor 300 via oil inlet conduit 380. Optionally, oil inlet conduit 380 may be positioned at or adjacent sump 376. Thus, lubrication oil to linear compressor 300 at oil inlet conduit 380 may flow into sump 376. As discussed above, oil cooling circuit 200 may cool lubrication oil from linear compressor 300. After such cooling, the lubrication oil is returned to linear compressor 300 via oil inlet conduit 380. Thus, the lubrication oil in oil inlet conduit 380 may be relatively cool and assist with cooling lubrication oil in sump 376.

In some embodiments, linear compressor 300 includes a pump 372. Pump 372 may be positioned at or adjacent a sump 376 of shell 302 (e.g., within a pump housing 374). Sump 376 corresponds to a portion of shell 302 at or adjacent a bottom of shell 302. Thus, a volume of lubrication oil 377 within shell 302 may pool within sump 376 (e.g., because the lubrication oil is denser than the refrigerant within shell 302). During use, pump 372 may draw the lubrication oil from the volume 377 within sump 376 to pump 372 via a supply line 378 extending from pump 372 to sump 376. For instance, a pair of check valves within a pump housing 374 at opposite ends of pump 372 may selectively permit/release oil to/from pump housing 374 as pump 372 oscillates within pump housing 374 (e.g., as motivated by oscillations of casing 308). Additionally or alternatively, the volume of lubrication oil 377 may be maintained at a predetermined level (e.g., even with a vertical midpoint of pump 372) while pump 372 is actively oscillating.

An internal conduit 384 may extend from pump 372 (e.g., pump housing 374) to an oil reservoir 386 defined within casing 308. In some embodiments, oil reservoir 386 is positioned radially outward from the chamber 312 of cylinder assembly 310. For instance, oil reservoir 386 may be defined to extend along the circumferential direction (e.g., about the axial direction A) as an annular chamber around chamber 312 of cylinder assembly 310.

Generally, lubrication oil may be selectively directed to cylinder assembly 310 from oil reservoir 386. In particular, one or more passages (e.g., radial passages) may extend from oil reservoir 386 to the chamber 312. Such radial passages may terminate at a portion of the sliding path of piston head 318 (e.g., between top dead center and bottom dead center relative to the axial direction A). As piston head 318 slides within chamber 312, a sidewall of piston head 318 may receive lubrication oil. In optional embodiments, the radial passages terminate at a groove 388 defined by the cylinder assembly 310 within the chamber 312. Thus, the groove 388 may be open to the chamber 312. Lubrication oil from oil reservoir 386 may flow into chamber 312 of cylinder assembly 310 (e.g., via radial passages to the groove 388) in order to lubricate motion of piston assembly 316 within chamber 312 of cylinder assembly 310.

Along with the chamber 312 and oil reservoir 386, casing 308 may define an oil exhaust 390. In some embodiments, oil exhaust 390 extends from oil reservoir 386. For example, oil exhaust 390 may extend through casing 308 outward from oil reservoir 386. Oil exhaust 390 may thus be in fluid communication with oil reservoir 386. During use, at least a portion of the lubrication oil urged to oil reservoir 386 may flow to the oil exhaust 390 (e.g., as motivated by pump 372). From oil exhaust 390, lubrication oil may exit the casing 308 (and linear compressor 300 generally). In certain embodiments, oil exhaust 390 is connected in fluid communication to the oil outlet conduit 382. Thus, pump 372 may generally urge lubrication oil from the internal volume 303, through casing 308, and to the oil outlet conduit 382. Oil outlet conduit 382 may be coupled to supply conduit 222 of oil cooling circuit 200 (FIG. 2). Thus, pump 372 may urge lubrication oil from sump 376 into supply conduit 222. In such a manner, pump 372 may supply lubrication oil to oil cooling circuit 200 in order to cool the lubrication oil from linear compressor 300, as discussed above. Separate from or in addition to oil exhaust 390, casing 308 may define a gas vent 392. In particular, gas vent 392 extends through from oil reservoir 386 to the internal volume 303. As shown, gas vent 392 is defined in fluid parallel with oil exhaust 390. Thus, fluid is separately directed through gas vent 392 and oil exhaust 390. Generally, gas vent 392 may be sized to restrict fluid more than oil exhaust 390. For example, the minimum diameter of gas vent 392 may still be smaller than the minimum diameter of the oil exhaust 390. Optionally, the minimum diameter of gas vent 392 may be less than two millimeters while the minimum diameter of oil exhaust is greater than four millimeters. Along with being smaller in diameter, the gas vent 392 may further be shorter in length than oil exhaust 390. Under typical pumping operations, a greater volume of lubrication oil may be motivated through oil exhaust 390 than gas vent 392. Nonetheless, gas (e.g., produced during an outgassing within oil reservoir 386) may be permitted to internal volume 303 through gas vent 392 while permitting the continued flow of lubrication oil from oil reservoir 386 to oil exhaust 390 or chamber 312.

Gas vent 392 may be defined at an upper portion of casing 308 (e.g., at an upper end of oil reservoir 386). Additionally or alternatively, gas vent 392 may extend above the discharge valve assembly 320 (e.g., parallel to the axial direction A). Gas vent 392 may further be located below (e.g., lower along a vertical direction V than) oil exhaust 390. In some embodiments, gas vent 392 is located at the second end portion 306 of casing 308. Fluid from gas vent 392 may be directed forward into internal volume 303.

In some embodiments, an oil shield 394 is provided in front of gas vent 392. As shown, oil shield 394 may be disposed on casing 308 (e.g., at second end portion 306). Between oil shield 394 and, for example, muffler housing 322, a drip passage may be defined. Between oil shield 394 and, for example, muffler housing 322, a drip passage may be defined. For instance, oil shield 394 may extend outward from casing 308 to a curved or inward-extending wall portion 396. Additionally or alternatively, oil shield 394 may extend about a portion of muffler housing 322. For instance, oil shield 394 may extend 180° along a top side of muffler housing 322. During use, lubrication oil discharged through gas vent 392 may be directed downward to the sump 376. During use, oil shield 394 may prevent lubrication oil from striking shell 302 (e.g., at a high velocity, which might otherwise cause atomizing of lubrication oil within internal volume 303).

Figure 5:
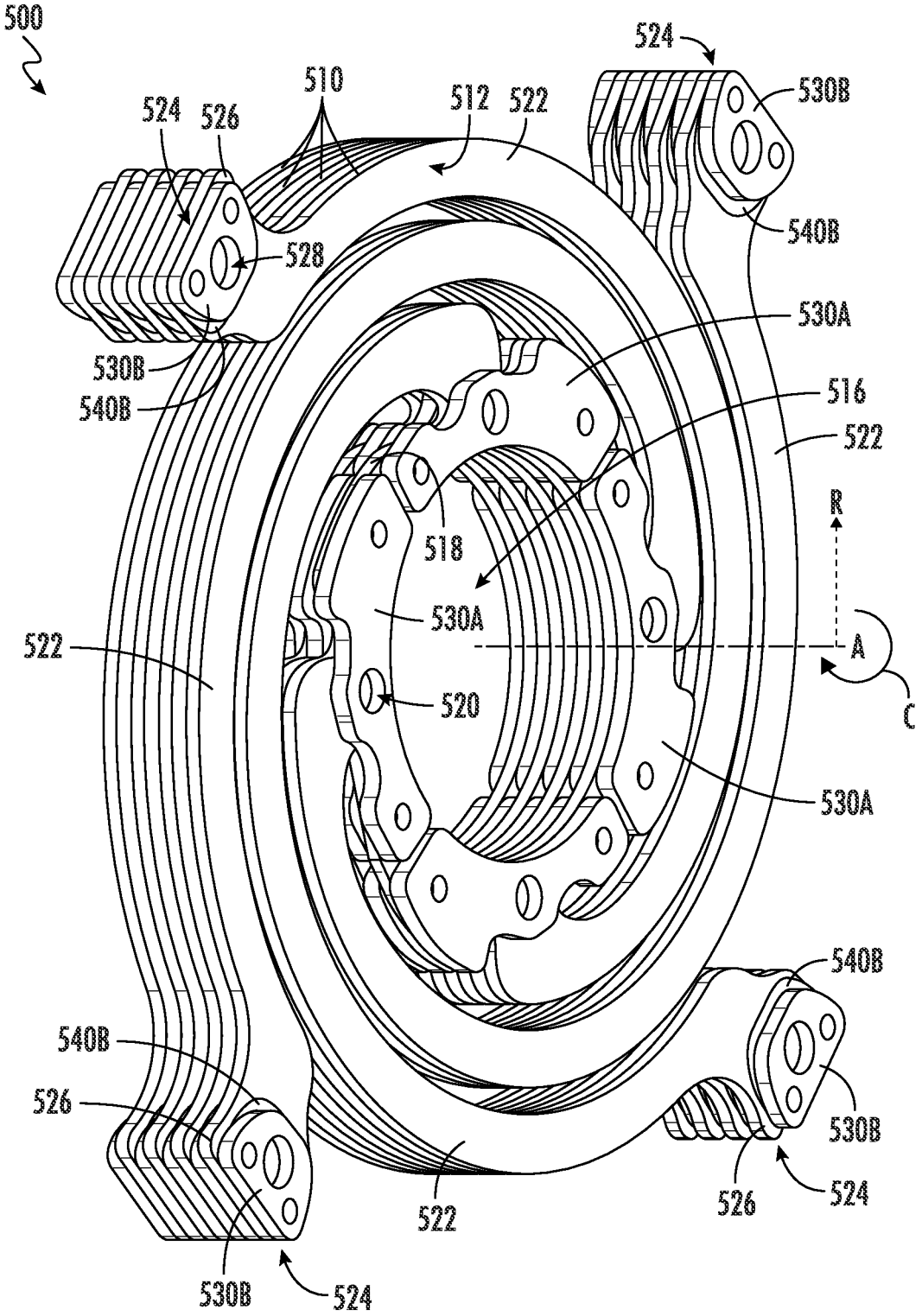
FIG. 5 provides a perspective view of a planar spring assembly of a refrigerator appliance according to exemplary embodiments of the present disclosure.
Figure 6:
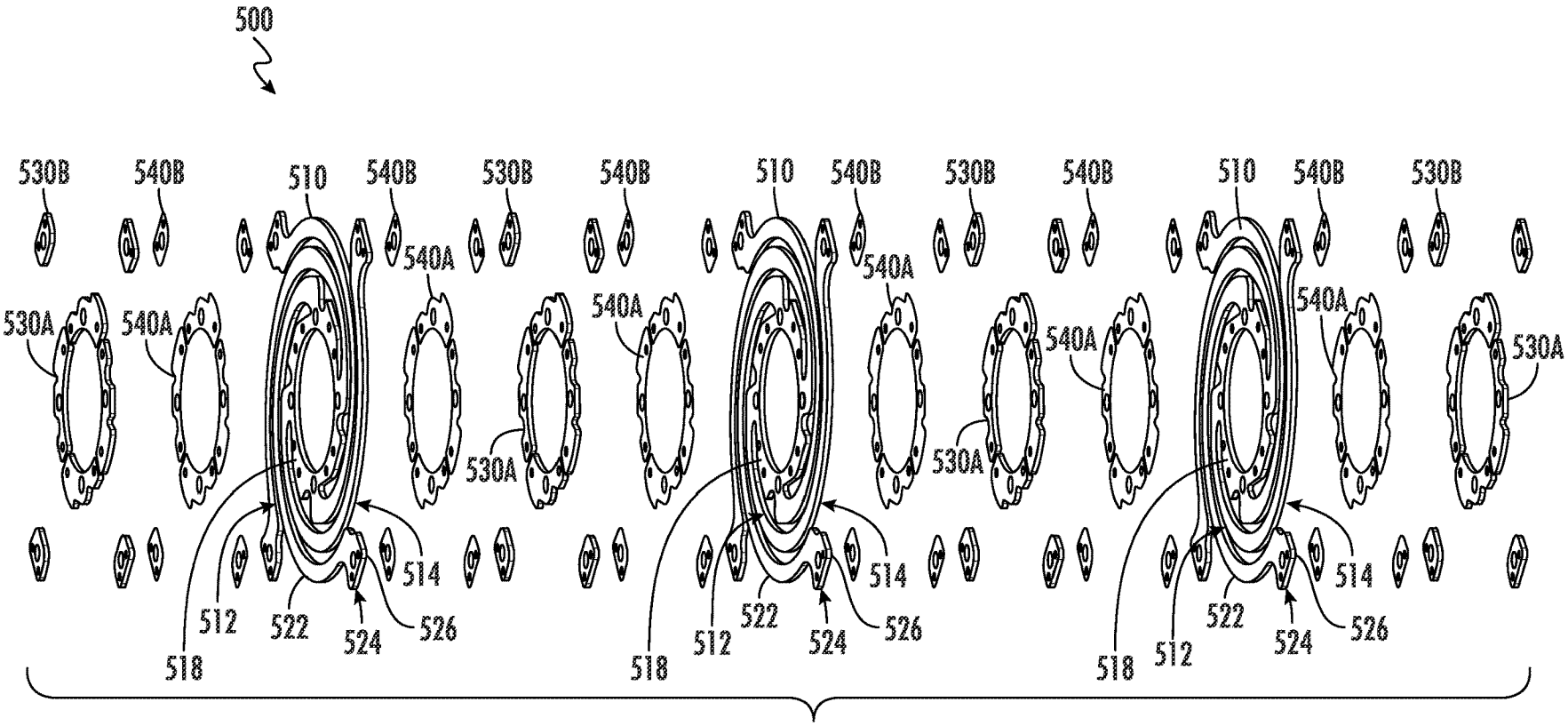
FIG. 6 provides an exploded perspective view of the exemplary planar spring assembly of FIG. 5.
Figure 7:
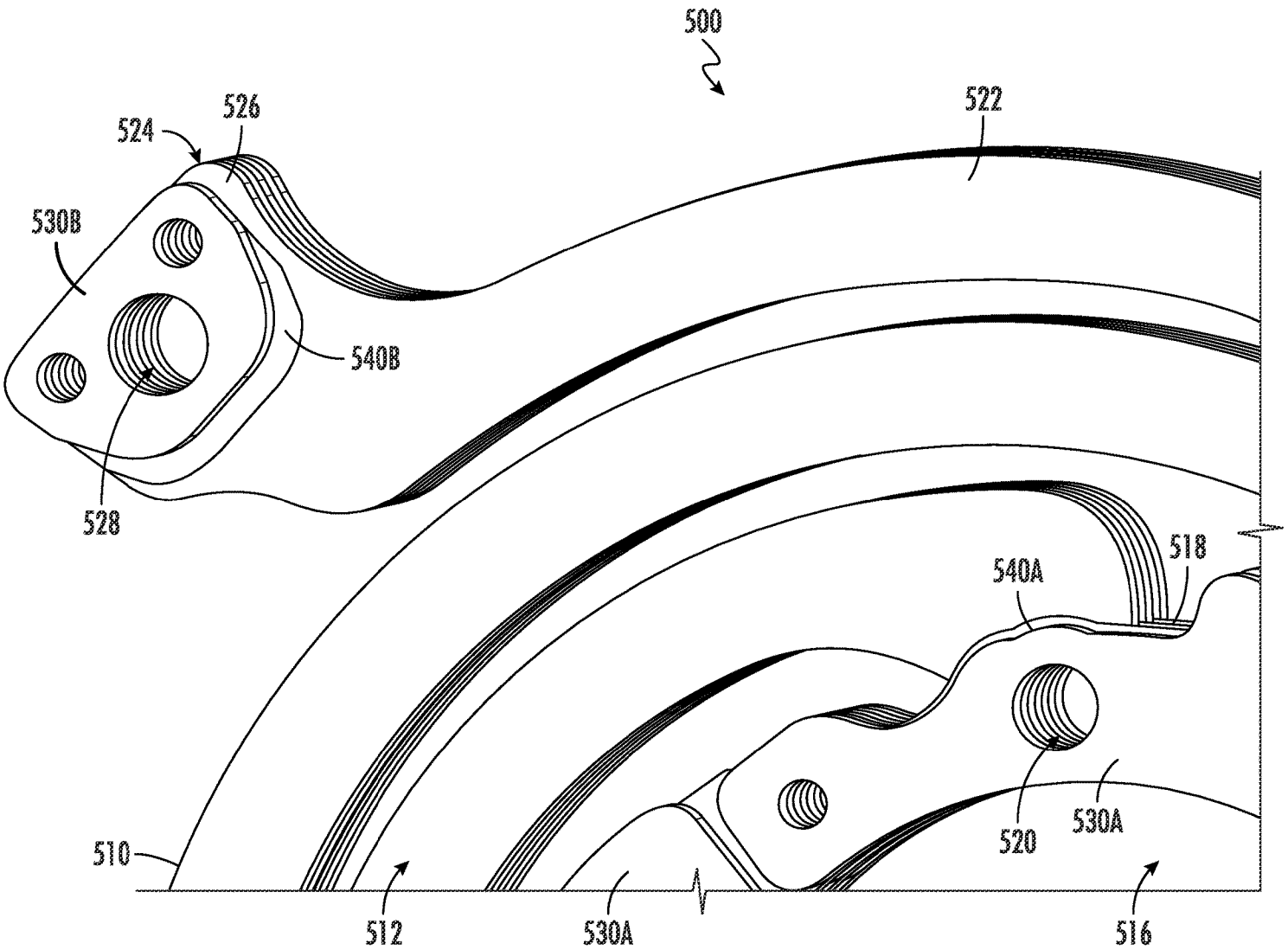
FIG. 7 provides a magnified perspective view of a portion of the exemplary planar spring assembly of FIG. 5.

Turning now to FIGS. 5 through 7, a planar spring assembly 500 will be described in greater detail. As is understood, planar spring assembly 500 may be provided with a suitable linear compressor (e.g., compressor 300-FIG. 3), such as with or as spring assemblies 340, 342 (FIG. 3).

Generally, planar spring assembly 500 includes multiple (i.e., at least two) planar springs 510 that are spaced apart from each other (e.g., along the axial direction A). Thus, planar spring assembly 500 includes at least a first planar spring 510 and a second planar spring 510. Additional planar springs 510 may be provided, such as four (FIG. 5) or three (FIGS. 6 and 7). Nonetheless, as would be understood in light of the present disclosure and except as otherwise indicated, planar spring assembly 500 is not limited to any specific number of planar springs 510 and may number thereof.

When assembled, each planar spring 510 disposed along (or otherwise defines) a radial plane perpendicular to the axial direction A. Thus, each planar spring 510 extends along a radial direction R perpendicular to the axial direction A. Moreover, each planar spring 510 of the planar spring assembly 500 may be parallel to some or all of the other planar springs 510. In some embodiments, each planar spring 510 defines a flat front face 512 and a flat rear face 514 that is parallel to the front face 512. For instance, the flat front face 512 and the flat rear face 514 may each extend directly along the radial direction R and parallel thereto (e.g., without undulating or deviating from a radial plane).

Each planar spring 510 may be formed from a metal material (e.g., stainless steel). In some such embodiments, a planar spring 510 is formed from a piece of sheet metal. Front face 512 and rear face 514 may thus generally maintain the same flat shape of the sheet metal and, for instance, maintain approximately the same thickness between the front and rear faces 512, 514 (i.e., along the axial direction A) as was present in the original sheet metal. Optionally, planar spring 510 may be cut or stamped from the original sheet metal material.

In certain embodiments, planar spring 510 defines a central void 516 extending along the axial direction A. An inner ring 518 may extend circumferentially about the central void 516 or about the axial direction A, generally. The inner ring 518 may continuous or unbroken along a circumferential direction C. Moreover, inner ring 518 may enclose the central void 516 along the circumferential direction C. Optionally, one or more ring apertures 520 may be defined (e.g., parallel to the axial direction A) through inner ring 518, such as to receive an inner fastener (e.g., fastener 350-FIG. 3). As shown, multiple ring apertures 520 may be defined through each inner ring 518 and circumferentially spaced apart from each other (i.e., defined as discrete circumferential locations).

In some embodiments, one or more radial arms 522 may extend from the inner ring 518 to a corresponding distal tip 524 (e.g., continuously with or as a separately joined member connected to inner ring 518). At the distal tip 524, a mounting tab 526 may be provided. A mounting aperture 528 may furthermore be defined (e.g., parallel to the axial direction A) through the mounting tab 526, such as to receive an outer fastener 344 (FIG. 3). Optionally, the radial arms 522 may extend radially along an arcuate path that extends along the circumferential direction C. Thus, between the inner ring 518 and the distal tip 524, each radial arm 522 may progress along both the radial direction R and the circumferential direction C (e.g., counter clockwise). In some such embodiments, each radial arm 522 defines multiple turns and, thus, encircles the inner ring 518 multiple times. In the illustrated embodiments, at least two turns are established (e.g., such that each radial arm 522 extends 720° or more about the axial direction A). In additional or alternative embodiments, the distal tips 524 of the radial arms 522 are circumferentially spaced apart. Optionally, an equal circumferential distance may be defined between each adjacent (e.g., circumferentially adjacent) mounting tab 526.

As noted above, the planar springs 510 are spaced apart from each other (e.g., along the axial direction A). One or more spacer plugs 530A, 530B may be disposed between adjacent (e.g., axially adjacent) planar springs 510 along the axial direction A. In turn, adjacent planar springs 510 may be maintained at a common axial distance without directly contacting each other. In some such embodiments, such as those having three or more planar springs 510, the spacer plugs 530A, 530B may all define a common axial thickness. Moreover, a common axial spacing may be provided between each planar spring 510. In other words, each of the planar springs 510 may be spaced apart from each other by the same distance.

Separate from or in addition to spacer plugs 530A, 530B between adjacent (e.g., axially adjacent) planar springs 510, one or more spacer plugs 530A, 530B may be disposed (e.g., directly or indirectly) on both the front face 512 and the rear face 514 of a planar spring 510 (e.g., each planar spring 510). Thus, a spacer plug 530A, 530B may be disposed on the front face 512 on the forwardmost planar spring 510 or the rear face 514 of the rearmost planar spring 510, even though no other planar spring 510 is adjacent (e.g., axially adjacent) to the front face 512 or the rear face 514, respectively. In turn, a spacer plug 530A, 530B may be held between a fastener head and the forwardmost planar spring 510 or between a fastener head and the rearmost spring. Moreover, the spacer plug 530A, 530B may prevent the fastener head from directly contacting the planar spring 510.

In certain embodiments, one or more (e.g., some or all) of the spacer plugs 530A, 530B are formed from a metal material, such as the same metal material as the planar springs 510. For instance, if the planar springs 510 are formed from sheet metal, the spacer plugs 530A, 530B may be formed from the same sheet metal (e.g., from the cut or stamped negatives for formation of a planar spring 510). Alternatively, a suitable rigid polymer material or other material distinct from the metal material of the planar springs 510 may be used.

Generally, the assembled spring assembly 500 may provide the spacer plugs 530A, 530B on or in axial alignment with one or more portions of an adjacent (e.g., axially adjacent) or corresponding planar spring 510.

In some embodiments, one or more inner plugs 530A are on or axially aligned with inner ring 518. Thus, the inner plug(s) 530A may axially separate adjacent (e.g., axially adjacent) planar springs 510 at their corresponding inner rings 518. Such inner plug(s) 530A may be disposed about the central void 516, thereby leaving the central void 516 unobscured. In some embodiments, multiple discrete inner plugs 530A may extend around the axial direction A. Each inner plug 530A may extend along or occupy a sub-portion (e.g., less than 360°) of the circumferential direction C. In turn, multiple inner plugs 530A may be used between two adjacent (e.g., axially adjacent) inner rings 518.

In additional or alternative embodiments, one or more outer plugs 530B are on or axially aligned with distal tips 524 (e.g., at mounting tabs 526). Thus, the outer plug(s) 530B may axially separate adjacent (e.g., axially adjacent) planar springs 510 at their corresponding distal tips 524 or mounting tabs 526. Such outer plugs 530B may be radially spaced apart from the inner rings 518 (or inner plug(s) 530A).

Separate from or in addition to the spacer plugs 530A, 530B, one or more polymer shim layers 540A, 540B may be disposed between adjacent (e.g., axially adjacent) planar springs 510 (or portions thereof). Such polymer shim layers 540A, 540B may directly contact at least one planar spring 510 (e.g., at the corresponding front face 512 or rear face 514) and notably prevent direct contact of another spring, plug, metal member or sub-portion of the spring 510, etc. against at least a portion of the corresponding planar spring 510. Moreover, such polymer shim layers 540A, 540B may advantageously prevent fretting fatigue at the planar springs 510.

Generally, the assembled spring assembly 500 may provide the polymer shim layers 540A, 540B on or in axial alignment with one or more portions of an adjacent (e.g., axially adjacent) or corresponding planar spring 510.

In some embodiments, one or more inner shim layers 540A are on or axially aligned with inner ring 518. Thus, the inner shim layer(s) 540A may axially separate adjacent (e.g., axially adjacent) planar springs 510 at their corresponding inner rings 518. Such inner shim layer(s) 540A may be disposed about the central void 516, thereby leaving the central void 516 unobscured. In some embodiments, multiple discrete inner shim layers 540A may extend around the axial direction A. Each inner shim layer 540A may extend along or occupy a sub-portion (e.g., less than) 360° of the circumferential direction C. In turn, multiple inner plugs 530A may be used between two adjacent (e.g., axially adjacent) inner rings 518.

In additional or alternative embodiments, one or more outer shim layers 540B are on or axially aligned with distal tips 524 (e.g., at mounting tabs 526). Thus, the outer shim layer(s) 540B may axially separate adjacent (e.g., axially adjacent) planar springs 510 at their corresponding distal tips 524 or mounting tabs 526. Such outer shim layers 540B may be radially spaced apart from the inner rings 518 (or inner plug(s) 530A).

Separate from or in addition to polymer shim layers 540A, 540B being between adjacent (e.g., axially adjacent) planar springs 510, one or more polymer shim layers 540A, 540B may be disposed (e.g., directly or indirectly) on any spacer plugs 530A, 530B between adjacent planar springs 510. In particular, a polymer shim layer 540A, 540B may be sandwiched between a spacer plug 530A, 530B and a planar spring 510 (e.g., at the front face 512 or rear face 514 thereof). Thus, a polymer shim layer 540A, 540B may be disposed on the front face 512 on the forwardmost planar spring 510 or the rear face 514 of the rearmost planar spring 510, even though no other planar spring 510 is adjacent (e.g., axially adjacent) to the front face 512 or the rear face 514, respectively. In some embodiments, a discrete polymer shim layer 540A, 540B may be held between at least one planar spring 510 and a spacer plug 530A, 530B. Moreover, the polymer shim layer 540A, 540B may prevent the spacer plug 530A, 530B from directly contacting the planar spring 510. Optionally, spacer plug 530A, 530B defines a radial plug footprint, wherein the polymer shim layer 540A, 540B defines a radial shim plug footprint axially aligned with and larger than the radial plug footprint. Thus, even if some slight (e.g., radial) shift or displacement occurs at spacer plug 530A, 530B, the corresponding polymer shim layer 540A, 540B may still prevent contact between the spacer plug 530A, 530B and the opposite planar spring assembly 500. If a spacer plug 530A, 530B is disposed between two adjacent (e.g., axially adjacent) planar springs 510, two discrete polymer shim layers 540A, 540B may be provided between the adjacent planar springs 510, such that a sequential pattern of a first planar spring 510, first polymer shim layer 540A, 540B, spacer plug 530A, 530B, second polymer shim layer 540A, 540B, and second planar spring 510 is established (e.g., as shown).

Generally, each polymer shim layer 540A, 540B is formed from a suitable wear-resistant polymer material. For example, the polymer material may include or be provided as biaxially-oriented polyethylene terephthalate (BoPET), polyphenylene sulfide (PPS), or polyether ether ketone (PEEK). Optionally, multiple (e.g., some or all) polymer shim layers 540A, 540B may be formed from the same material. For example, the outer shim layers 540B may be formed from the same (e.g., first) polymer material. Additionally or alternatively, two or more polymer shim layers 540A, 540B may be formed from different materials. For example, the outer shim layers 540B may be formed from one (e.g., first) polymer material while the inner shim layers 540A are formed from another (e.g., second) material that is different from the first polymer material.

In some embodiments, one or more polymer shim layers 540A, 540B includes or is provided as a polymer sheet (e.g., as shown). In additional or alternative embodiments, one or more polymer shim layers 540A, 540B includes or is formed as a polymer coating formed (e.g., directly) on a surface of the corresponding planar spring 510, such as by liquid application, overmolding, or vapor deposit, as would be understood in light of the present disclosure. Irrespective of whether the polymer shim layers 540A, 540B are sheets or coatings (or another suitable structure), such polymer shim layers 540A, 540B may be relatively thin (e.g., in comparison to planar spring 510). For instance, the polymer shim layers 540A, 540B may define an axial thickness that is less than or equal to 10% of the axial thickness of the planar springs 510. In some embodiments, the axial thickness of a polymer shim layer 540A, 540B is between 0.03 millimeters and 0.3 millimeters. In additional or alternative embodiments, the axial thickness of a polymer shim layer 540A, 540B is between 0.05 millimeters and 0.2 millimeters. In further embodiments, the axial thickness of a polymer shim layer 540A, 540B is about 0.13 millimeters.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A linear compressor for an appliance, the linear compressor comprising:

a casing comprising a cylinder assembly defining a chamber along an axial direction;

a piston slidably received within the chamber of the cylinder assembly;

a driving coil;

an inner back iron assembly positioned in the driving coil; and a planar spring assembly mounted to the inner back iron assembly, the planar spring assembly comprising a first planar spring, a second planar spring axially spaced apart from the first planar spring, a polymer shim layer disposed between at least a portion of the first planar spring and the second planar spring, and a spacer plug disposed between the first planar spring and the second planar spring, wherein the polymer shim layer is sandwiched between the spacer plug and the first planar spring.

2. The linear compressor of claim 1, wherein the first and second planar springs comprise a metal material.

3. The linear compressor of claim 2, wherein the spacer plug comprises the metal material.

4. The linear compressor of claim 1, wherein the spacer plug defines a radial plug footprint, wherein the polymer shim layer defines a radial shim plug footprint axially aligned with and larger than the radial plug footprint.

5. The linear compressor of claim 1, wherein the first planar spring comprises an inner ring extending circumferentially about the axial direction, a radial arm extending from the inner ring to a distal tip, wherein the polymer shim layer is an inner shim layer axially aligned with the inner ring, and wherein the planar spring assembly further comprises an outer shim layer radially spaced apart from the inner shim layer and axially aligned with the radial arm at the distal tip.

6. The linear compressor of claim 5, wherein the inner shim layer comprises a first polymer material, and wherein the outer shim layer comprises a second polymer material, the second polymer material being different from the first polymer material.

7. The linear compressor of claim 5, wherein the inner shim layer comprises a first polymer material, and wherein the outer shim layer comprises the first polymer material.

8. The linear compressor of claim 1, wherein the polymer shim layer comprises a polymer sheet.

9. The linear compressor of claim 1, wherein the polymer shim layer comprises a polymer coating formed on the first planar spring.

10. A sealed system for an appliance, comprising:

a linear compressor defining an axial direction and comprising a casing comprising a cylinder assembly defining a chamber;

a piston slidably received within the chamber of the cylinder assembly;

a driving coil;

an inner back iron assembly positioned in the driving coil; and a first planar spring mounted to the inner back iron assembly, a second planar spring mounted to the inner back iron assembly and axially spaced apart from the first planar spring, a polymer shim layer disposed between at least a portion of the first planar spring and the second planar spring, and a spacer plug disposed between the first planar spring and the second planar spring, wherein the polymer shim layer is sandwiched between the spacer plug and the first planar spring;

a shell defining an internal volume enclosing the linear compressor and lubrication oil therein;

a condenser in downstream fluid communication with the linear compressor to receive a compressed refrigerant therefrom; and an evaporator in upstream fluid communication with the linear compressor to direct an expanded refrigerant thereto.

11. The sealed system of claim 10, wherein the first and second planar springs comprise a metal material.

12. The sealed system of claim 11, wherein the spacer plug comprises the metal material.

13. The sealed system of claim 10, wherein the spacer plug defines a radial plug footprint, wherein the polymer shim layer defines a radial shim plug footprint axially aligned with and larger than the radial plug footprint.

14. The sealed system of claim 10, wherein the first planar spring comprises an inner ring extending circumferentially about the axial direction, a radial arm extending from the inner ring to a distal tip, wherein the polymer shim layer is an inner shim layer axially aligned with the inner ring, and wherein linear compressor further comprises an outer shim layer radially spaced apart from the inner shim layer and axially aligned with the radial arm at the distal tip.

15. The sealed system of claim 14, wherein the inner shim layer comprises a first polymer material, and wherein the outer shim layer comprises a second polymer material, the second polymer material being different from the first polymer material.

16. The sealed system of claim 14, wherein the inner shim layer comprises a first polymer material, and wherein the outer shim layer comprises the first polymer material.

17. The sealed system of claim 10, wherein the polymer shim layer comprises a polymer sheet.

18. The sealed system of claim 10, wherein the polymer shim layer comprises a polymer coating formed on the first planar spring.

19. A linear compressor for an appliance, the linear compressor comprising:

a casing comprising a cylinder assembly defining a chamber along an axial direction;

a piston slidably received within the chamber of the cylinder assembly;

a driving coil;

an inner back iron assembly positioned in the driving coil; and a planar spring assembly mounted to the inner back iron assembly, the planar spring assembly comprising a first planar spring comprising an inner ring extending circumferentially about the axial direction and a radial arm extending from the inner ring to a distal tip, a second planar spring axially spaced apart from the first planar spring, and a polymer shim layer disposed between at least a portion of the first planar spring and the second planar spring, the polymer shim layer comprising an inner shim layer axially aligned with the inner ring, and an outer shim layer radially spaced apart from the inner shim layer and axially aligned with the radial arm at the distal tip.

20. The sealed system of claim 19, wherein the spacer plug defines a radial plug footprint, wherein the inner shim layer defines a radial shim plug footprint axially aligned with and larger than the radial plug footprint.

* * * * *